US009159268B2

(12) United States Patent
Shin

(10) Patent No.: US 9,159,268 B2
(45) Date of Patent: Oct. 13, 2015

(54) ORGANIC LIGHT EMITTING DIODE DISPLAY AND ITS DRIVING METHOD

(71) Applicant: LG Display Co., Ltd., Seoul (KR)

(72) Inventor: Areum Shin, Daejeon (KR)

(73) Assignee: LG Display Co., Ltd., Seoul (KR)

( * ) Notice: Subject to any disclaimer, the term of this patent is extended or adjusted under 35 U.S.C. 154(b) by 181 days.

(21) Appl. No.: 13/895,031

(22) Filed: May 15, 2013

(65) Prior Publication Data

US 2013/0307885 A1 Nov. 21, 2013

(30) Foreign Application Priority Data

May 17, 2012 (KR) ..... 10-2012-0052570

(51) Int. Cl.
*G09G 3/32* (2006.01)

(52) U.S. Cl.
CPC ..... *G09G 3/3275* (2013.01); *G09G 3/3266* (2013.01); *G09G 3/3233* (2013.01); *G09G 2300/0861* (2013.01)

(58) Field of Classification Search
CPC ..... G09G 3/3275; G09G 3/3266
USPC ..... 345/691, 82
See application file for complete search history.

(56) References Cited

U.S. PATENT DOCUMENTS

| | | | | |
|---|---|---|---|---|
| 6,181,317 | B1 * | 1/2001 | Taguchi et al. | 345/698 |
| 6,577,348 | B1 * | 6/2003 | Park | 348/554 |
| 7,903,070 | B2 * | 3/2011 | Moon et al. | 345/98 |
| 8,188,963 | B2 * | 5/2012 | Park | 345/99 |
| 2004/0233141 | A1 | 11/2004 | Matsumoto | |
| 2008/0001893 | A1 * | 1/2008 | Moon et al. | 345/98 |
| 2008/0238835 | A1 | 10/2008 | Asano et al. | |

FOREIGN PATENT DOCUMENTS

| | | | |
|---|---|---|---|
| CN | 10-1738794 | A | 6/2010 |
| JP | 2004-318093 | A | 11/2004 |
| JP | 2007-310158 | A | 11/2007 |
| JP | 2008-250093 | A | 10/2008 |

* cited by examiner

*Primary Examiner* — Allison Johnson
*Assistant Examiner* — Afroza Chowdhury
(74) *Attorney, Agent, or Firm* — Fenwick & West LLP

(57) ABSTRACT

An organic light emitting diode display and its driving method, in which gate signals input to transistors may be input to one pixel at an interval corresponding to ½ period of a gate shift clock. The organic light emitting diode display comprises a panel including a plurality of pixels formed by crossings of gate lines and data lines, each pixel including an organic light emitting diode and transistors; a timing controller configured to generate a gate shift clock; and a gate driver configured to receive the gate shift clock and output a plurality of gate signals to the transistors of each of the pixels based on the gate shift clock, the gate driver outputting at least one of the gate signals to a corresponding one of the transistors shifted by a time interval of one half of a period of the gate shift clock.

13 Claims, 9 Drawing Sheets

ORGANIC LIGHT EMITTING DIODE DISPLAY AND ITS DRIVING METHOD

CROSS REFERENCE TO RELATED APPLICATIONS

This application claims the benefit of the Korean Patent Application No. 10-2012-0052570 filed on May 17, 2012, which is hereby incorporated by reference for all purposes as if fully set forth herein.

BACKGROUND

1. Technical Field

The present invention relates to an organic light emitting diode display, and more particularly, to an organic light emitting diode display and its driving method, in which three or more transistors are provided in each pixel.

2. Discussion of the Related Art

Examples of flat panel displays (FPDs) which has been recently used widely include a liquid crystal display (LCD), a field emission display (FED), a plasma display panel (PDP), and an electroluminescence device.

Since the PDP is simple in its structure and manufacturing process, it has received attention as a display which is lightweight, thin, short and small, and is the most advantageous for a large sized screen. However, the PDP has a problem in that it has low light emitting efficiency and luminance and has high power consumption. Although a thin film transistor (TFT) LCD to which a TFT is applied as a switching device is the flat panel display device which is used most widely, since it is a non-light emitting device, it has a problem in that a viewing angle is narrow and a response speed is low.

By contrast, the electroluminescence device is classified into an inorganic light emitting diode display and an organic light emitting diode display depending on a material of a light emitting layer. Particularly, the organic light emitting diode display has advantages in that a response speed is fast, and the light emitting efficiency, luminance and viewing angle are improved compared to the other types of FPDs described above by using a self-light emitting device that light emits by itself.

FIG. 1 is a circuit diagram illustrating a structure of one pixel of an organic light emitting diode display according to the related art, specifically illustrating a pixel structure of two N type transistors. FIG. 2 is an exemplary view illustrating various waveforms applied to an organic light emitting diode display according to the related art, especially illustrating waveforms applied to an organic light emitting diode display that requires four gate signals for one pixel.

As shown in FIG. 1, a pixel 50 of the organic light emitting diode display according to the related art may include an organic light emitting diode (OLED) and at least two transistors T1 and T2 connected to a data line DL and a gate line Gn to control the organic light emitting diode (OLED).

An anode electrode of the organic light emitting diode is connected to a first power source VDD, and its cathode electrode is connected to a second power source VSS. The organic light emitting diode generates light of predetermined luminance in response to a current supplied from the second transistor T2.

Various circuits formed in the pixel 50 control the amount of current supplied to the organic light emitting diode in response to an image signal supplied to a data line DL when a scan signal is supplied to the gate line Gn. To this end, the pixel 50 includes the second transistor T2 (driving transistor) connected between the first power source VDD and the organic light emitting diode, the first transistor T1 (switching transistor) connected among the second transistor T2, the data line DL and the gate line Gn, and a storage capacitor Cst connected between a gate electrode of the second transistor T2 and the organic light emitting diode.

In the meantime, although only one gate signal (scan signal) may be input to the organic light emitting diode display shown in FIG. 1, the organic light emitting diode display generally uses two or more gate signals.

In other words, each pixel 50 of the aforementioned organic light emitting diode display needs a compensation circuit to remove luminance non-uniformity, that is, Mura defects, as well as the switching transistor T1 and the driving transistor T2. Accordingly, a plurality of gate signals are required to control a plurality of transistors applied to the compensation circuit. Examples of the gate signals may include various kinds of signals such as an emission signal for controlling an emission transistor in addition to the scan signal for controlling the switching transistor that supplies an image signal (data voltage) transmitted through the data line to the pixel.

Accordingly, the organic light emitting diode display according to the related art may include three or more transistors in one pixel, or may include four or more transistors.

In other words, although one gate signal (scan signal) is only transmitted to one pixel in a liquid crystal display, at least two gate signals including the scan signal should be transmitted to one pixel in the organic light emitting diode display, whereby the pixel may be driven normally.

Particularly, in case of a gate driver of the organic light emitting diode display in which four gate signals should be applied to one pixel, as shown in FIG. 2, a gate output enable signal GOE is fixed at low level L, and each gate signal is synchronized at one clock (gate shift clock (GSC)), whereby four gate signals are respectively output at the time of rising of the clock.

However, since the organic light emitting diode display of the related art has no option whether to output a gate signal at the time of rising of the gate shift clock GSC or at the time of falling of the gate shift clock GSC, transistors adjacent to one another within one pixel are operated in a unit of 1 period of the clock CLK. In other words, as shown in FIG. 2, supposing that the period between the rising time of the gate shift clock GSC and next rising time is 1 period, in the organic light emitting diode display of the related art, a first gate signal X1 input to the first transistor and a fourth gate signal X4 input to the fourth transistor are output to the pixel at the time of rising of the gate shift clock, and a second gate signal X2 input to the second transistor and a third gate signal X3 input to the third transistor are output to the pixel at the time of next rising of the gate shift clock. The gate signals X5, X8, X6, and X7 describe gate signals input to transistors of another pixel.

In other words, the respective gate signals are input to the pixel at an interval as much as 1 period (1 clock) of the gate shift clock.

As described above, in the organic light emitting diode display of the related art, since the gate signals are input to one pixel at an interval as much as 1 period of the gate shift clock, the time for driving all the transistors formed in one pixel is increased. For this reason, a problem occurs in that the time when an image is output is delayed.

SUMMARY

Accordingly, the present invention is directed to an organic light emitting diode display and its driving method, which substantially obviate one or more problems due to limitations and disadvantages of the related art.

An advantage of the present invention is to provide an organic light emitting diode display and its driving method, in which gate signals input to transistors adjacent to one another may be input to one pixel at an interval corresponding to at least ½ period of a gate shift clock.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an organic light emitting diode display comprises: a panel including a plurality of pixels formed by crossings of a plurality of gate lines and a plurality of data lines, each pixel including an organic light emitting diode and a plurality of transistors; a timing controller configured to generate a gate shift clock; and a gate driver configured to receive the gate shift clock and output a plurality of gate signals to the plurality of transistors of each of the pixels based on the gate shift clock, the plurality of transistors turned on or turned off based on the plurality of gate signals, the gate driver outputting at least one of the gate signals to a corresponding one of the plurality of transistors shifted by a time interval of one half of a period of the gate shift clock.

In another aspect of the present invention, a method for driving an organic light emitting diode display comprising: a panel including a plurality of pixels formed by crossings of a plurality of gate lines and a plurality of data lines, each pixel including an organic light emitting diode and a plurality of transistors, the method comprising: receiving a gate shift clock; and outputting a plurality of gate signals to the plurality of transistors of each of the plurality of pixels based on the gate shift clock, the plurality of transistors turned on or turned off based on the plurality of gate signals, at least one gate signal outputted to a corresponding one of the plurality of transistors shifted by a time interval of one half a period of the gate shift clock.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Reference will now be made in detail to the exemplary embodiments of the present invention, examples of which are illustrated in the accompanying drawings. Wherever possible, the same reference numbers will be used throughout the drawings to refer to the same or like parts.

Figure 1:
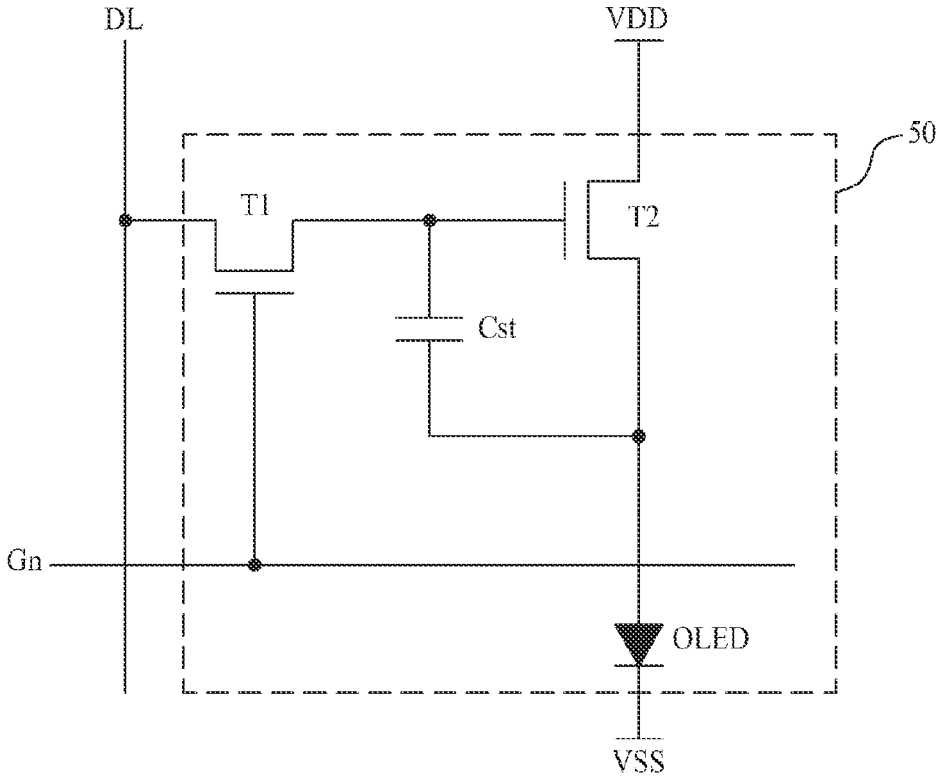
FIG. 1 [ Related Art ]
FIG. 1 is a circuit diagram illustrating a structure of one pixel of an organic light emitting diode display according to the related art.
Figure 2:
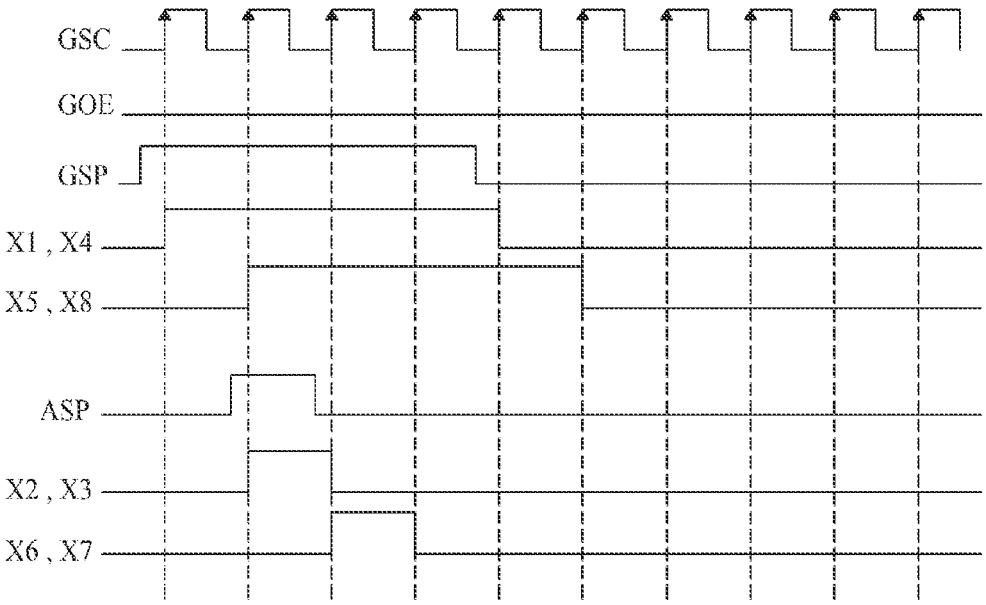
FIG. 2 [ Related Art ]
FIG. 2 is an exemplary view illustrating various waveforms applied to an organic light emitting diode display according to the related art.
Figure 3:
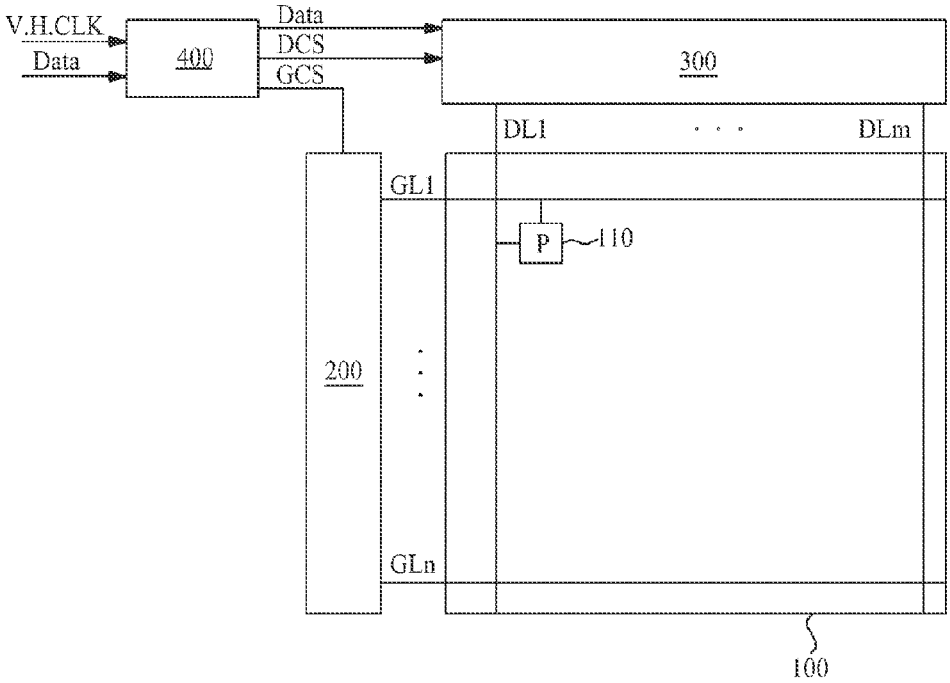
FIG. 3 is a schematic view illustrating an example of an organic light emitting diode display according to one embodiment.
Figure 4:
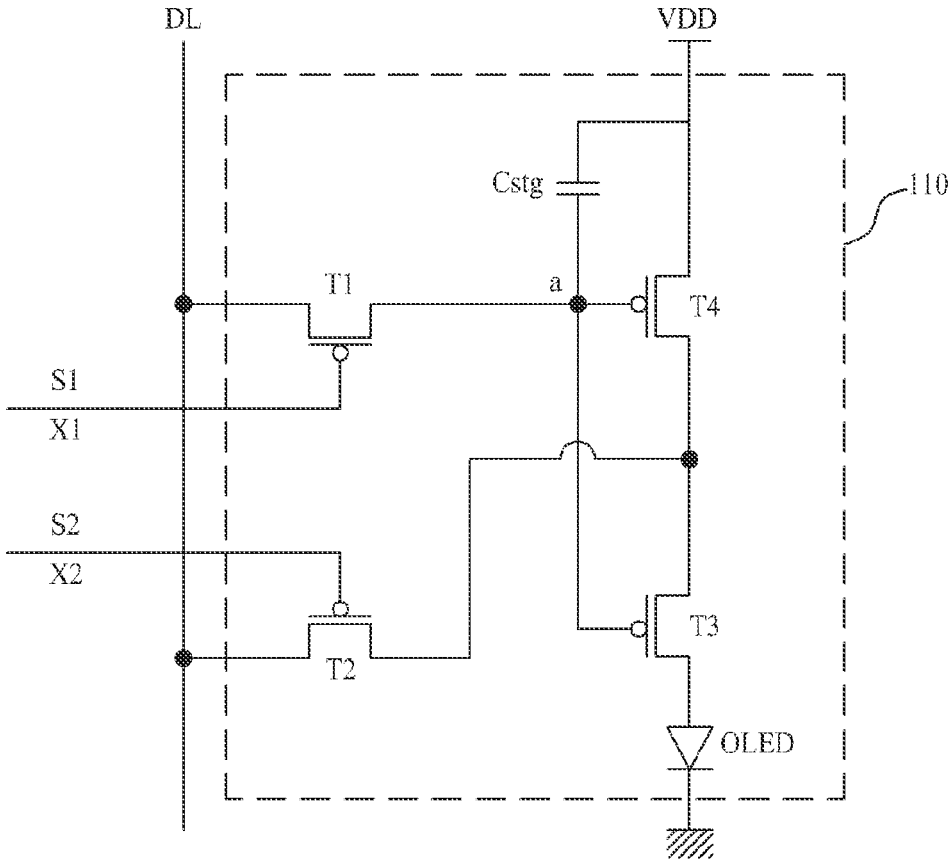
FIG. 4 is a schematic view illustrating an example of a pixel applied to an organic light emitting diode display according to one embodiment.

FIG. 3 is a schematic view illustrating an example of an organic light emitting diode display according to one embodiment. FIG. 4 is a schematic view illustrating an example of a pixel applied to an organic light emitting diode display according to one embodiment.

An organic light emitting diode and its driving method according to the present invention are characterized in that a plurality of gate signals are input to transistors formed in one pixel at an interval as much as at least ½ period of a gate shift clock. That is, at least one gate signal is input to a transistor of a pixel shifted by an interval of ½ a period of the gate shift clock according to one embodiment.

In other words, although one gate signal (scan signal) is input for 1 period of the gate shift clock in the LCD, since a plurality of transistors are formed to drive one pixel in the organic light emitting diode display as described below, a plurality of gate signals (including a scan signal and an emission signal) for driving the plurality of transistors should be input to the transistors.

Since the plurality of gate signals are input to the pixel only at the time of rising of the gate shift clock in the related art, a time interval of the gate signals output to a panel has corresponded to at least 1 period of the gate shift clock.

However, according to the present invention, the plurality of gate signals are output to the pixel at a time interval corresponding to at least ½ period of the gate shift clock, whereby the driving time of the transistor becomes fast and thus output picture quality of an image is improved. That is, at least one gate signal is output to a transistor of the pixel at an interval of ½ a period of the gate shift clock to improve the driving time of the transistor.

Hereinafter, an organic light emitting diode display configured such that two gate signals are input to each pixel formed in a panel and an organic light emitting diode display configured such that four gate signals are input to each pixel formed in a panel will be described as examples of the present invention. In other words, although the present invention may be applied to all the cases where two or more gate signals are input to each pixel formed in a panel, for convenience of description, the organic light emitting diode display in which two or four gate signals are input to each pixel will be described as an example of the present invention.

To this end, as shown in FIG. 3, the organic light emitting diode display according to the present invention includes a timing controller 400 outputting a gate control signal GCS and a data control signal DCS for respectively controlling driving of a gate driver 200 and a data driver 300 and sampling, realigning and outputting digital video data RGB, the gate driver 200 supplying a scan signal to each of gate lines GL1 to GLn of a panel 100 in response to the gate control signal, the data driver 300 supplying an analog data voltage (hereinafter, simply referred to as 'image signal') to each of data lines DL1 to DLm of the panel in response to the data control signal, and the panel 100 provided with pixels of a matrix arrangement driven by the scan signal and the image signal. In addition, the organic light emitting diode display according to the present invention further includes a power supply (not shown) for supplying the required power to the aforementioned elements.

First of all, the timing controller 400 outputs the gate control signal GCS for controlling the gate driver 200 and the data control signal DCS for controlling the data driver 300 by using vertical/horizontal synchronizing signals V and H and a clock signal CLK supplied from a system (not shown). Also, the timing controller 400 samples and realigns input image data input from the system and supplies the realigned digital image data to the data driver 300.

In other words, the timing controller 400 realigns the input image data supplied from the system, transmits the realigned digital image data to the data driver 300, generates the gate control signal GCS and the data control signal DCS by using the clock signal CLK, the horizontal synchronizing signal Hsync and the vertical synchronizing signal Vsync (these signals may simply be referred to as timing signals) supplied from the system, and transmit the generated gate control signal GCS and the generated data control signal DCS to the gate driver 200 and the data driver 300.

In order to perform the aforementioned functions, the timing controller 400 may include a receiver (not shown) receiving the aforementioned various signals from the system, an image data processor (not shown) realigning input image data of the signals received by the receiver and outputting the realigned image data, and a control signal generator (not shown) for generating various control signals for controlling the gate driver and the data driver by using the signals received by the receiver.

The gate control signal GCS generated by the timing controller 400 and transmitted to the gate driver 200 includes the gate shift clock GSC and a gate start pulse GSP.

Next, the gate driver 200 sequentially supplies scan signals to the gate lines GL1 to GLn of the panel in response to the gate control signal input from the timing controller. As a result, thin film transistors TFTs formed in each pixel of a corresponding horizontal line to which the scan signals are input are turned on, whereby an image may be output to each pixel. A structure and functions of the gate driver 200 will hereinafter be described in more detail with reference to FIG. 5 to FIG. 10.

Next, the data driver 300 converts the digital image data RGB to the analog image signal (data voltage) corresponding to a grayscale value in response to the data control signal input from the timing controller, and supplies the converted image signal to the data lines DL1 to DLm on the panel 100.

Finally, in the panel 100, a pixel P 110 is formed in each region where the plurality of gate lines GL cross the plurality of data lines DL. As shown in FIG. 4, each pixel may include a fourth transistor T4 and a third transistor T3 in addition to the first transistor T1 and the second transistor T2. The fourth transistor T4 and the third transistor T3 are connected between a power source terminal VDD and an organic light emitting diode OLED in series to supply a driving current to the organic light emitting diode OLED. A storage capacitor Cstg is connected between a source terminal and a gate terminal of the fourth transistor T4 at node a. The source terminal and drain terminal of the first transistor T1 are respectively connected between the data line DL and the gate terminals of the fourth transistor T4 and the third transistor T3 at node a. The gate of the first transistor T1 is connected to a first gate signal line S1. The source and drain terminals of the second transistor T2 are respectively connected between the data line DL and a connection point at the drain and source terminals of the fourth transistor T4 and the third transistor T3. The gate of the second transistor T2 is connected to a second gate signal line S2. In this case, two gate signals X1 and X2 are input to one pixel via the first gate signal line S1 and the second gate signal line S2, respectively.

However, various modifications may be made in a connection structure of the transistors for receiving two gate signals from one pixel. In other words, the present invention is characterized in the structure of the gate driver 200 for inputting two or more gate signals to one pixel. Accordingly, various modifications may be made in a connection method of the transistors. In other words, as described above, the present invention may be applied in the case that three or more gate signals are input to one pixel. In this case, various modifications may be made in the structure of the transistors. Also, although the pixel that includes a P type transistor is shown in FIG. 4, it may include a N type transistor.

Figure 5:
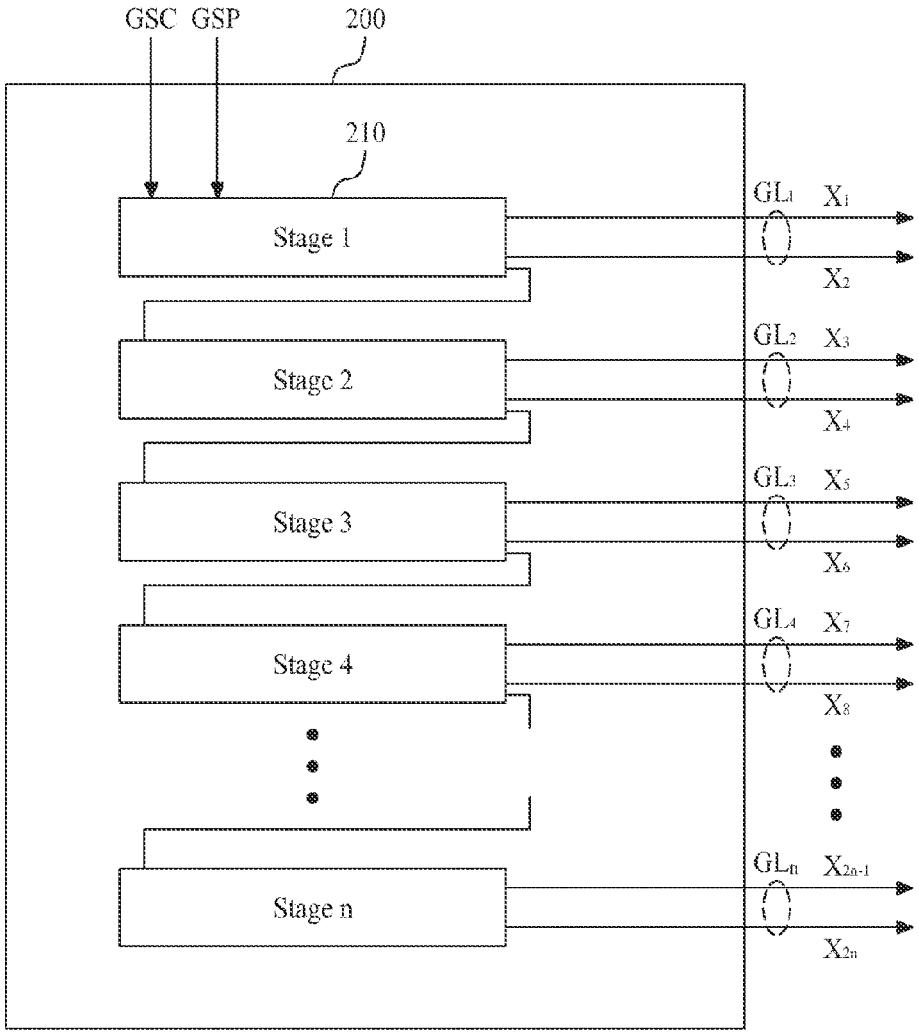
FIG. 5 is an exemplary view illustrating an inner structure of a gate driver applied to an organic light emitting diode display according to one embodiment.
Figure 6:
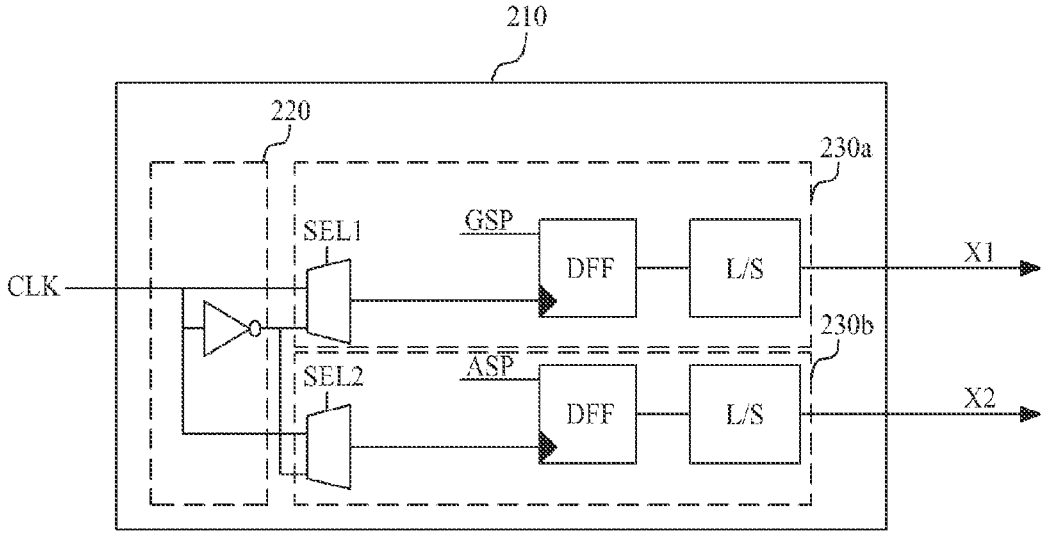
FIG. 6 is an exemplary view illustrating an inner structure of a stage applied to an organic light emitting diode display according to the first embodiment.
Figure 7:
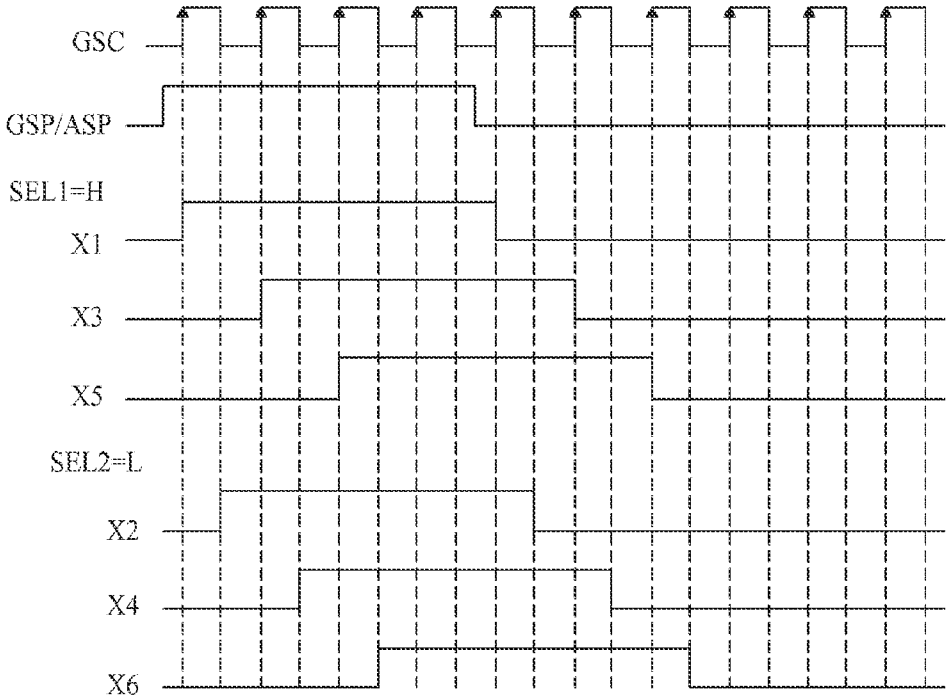
FIG. 7 is an exemplary view illustrating various waveforms applied to an organic light emitting diode display according to the first embodiment shown in FIG. 6.

FIG. 5 is an exemplary view illustrating an inner structure of a gate driver 200 applied to an organic light emitting diode display according to the present invention, FIG. 6 is an exemplary view illustrating an inner structure of a stage applied to an organic light emitting diode display according to the first embodiment of the present invention, and FIG. 7 is an exemplary view illustrating various waveforms applied to an organic light emitting diode display according to the first embodiment of the present invention, especially illustrating an organic light emitting diode display that uses two gate signals.

First, the gate driver 200 will be described with reference to FIG. 5.

As shown in FIG. 5, the gate driver 200 includes stages 210 such as stages Stage 1 to Stage n that include a plurality of thin film transistors. The stages 210 are connected to one another in a cascade arrangement and generate the gate signals X1 and $X_{2n}$ in due order. In the cascade arrangement, the gate shift clock GSC may be outputted by one stage is an input to another stage. For example, Stage 1 may output the gate shift clock GSC which is received as input by Stage 2. Similarly, Stage 2 may output the gate shift clock GSC which is received as input by Stage 3 and so on.

The first stage Stage 1 of the stages Stage 1 to Stage n is driven by the gate start pulse GSP transmitted from the timing controller 400 and transmits the gate shift clock GSC transmitted from the timing controller 400 to each stage in due order, whereby each stage may output the gate signals based on the gate shift clock.

The gate signals output from each stage include two gate signals X1 and X2 as described above, and gate signal lines S1 and S2 to which these gate signals are input will be referred to as the gate line GL. As shown in FIG. 3, since the n number of gate lines GL1 to GLn are provided, the gate driver 200 includes n number of stages Stage 1 to Stage n. The gate line GL output from each stage may include two gate signal lines for applying two gate signals to the transistors formed in each pixel.

Next, the inner structure of each stage 210 will be described with reference to FIG. 6.

As shown in FIG. 6, each stage 210 includes an inverter unit 220 for inverting input clock CLK, and a plurality of selectors 230 for receiving the inverted signal output from the inverter unit 220, the clock CLK, a selection signal SEL and an input signal and outputting the gate signals at the time of rising or falling of the clock in accordance with a level of the selection signal.

The clock CLK may be the gate shift clock transmitted from the timing controller 400. Hereinafter, the gate shift clock will simply be referred to as the clock.

The inverter unit 220 serves to invert the clock and transmit the inverted clock to each of the plurality of selectors 230*a* and 230*b*.

The number of selectors 230*a* and 230*b* included in stage 210 corresponds to the number of gate signals to be output by the stage 210. Particularly, if each pixel formed in the panel needs two gate signals as shown in FIG. 4, two selectors may be provided as shown in FIG. 6.

Each of the selectors 230*a* and 230*b* receives the clock, the inverted signal output from the inverter unit 220, the selection signal (e.g., SEL1 or SEL2), and the input signal (e.g., GSP or ASP where ASP represents a generic start pulse signal), and synchronizes the input signal at the time of rising of the clock and outputs the input signal as the gate signal if the selection signal SEL corresponds to a high level H, whereas each of the selectors 230*a* and 230*b* synchronizes the input signal at the time of falling of the clock and outputs the input signal as the gate signal if the selection signal SEL corresponds to a low level L.

For example, if the selection signal SEL1 input to the first selector 230*a* connected with the first transistor T1 corresponds to a high level H, the first selector 230*a* synchronizes a first input signal GSP at the time of rising of the clock and outputs the first input signal as the first scan signal X1.

In this case, the values (high level or low level) of the first selection signal SEL1 and the second selection signal SEL2 may previously be selected by a manufacturer of the organic light emitting diode display according to the present invention and stored in the gate driver 200.

Also, although the first input signal GSP and the second input signal ASP are shown in FIG. 7 as the same waveform, the two input signals may be different from each other. In this case, the first gate signal may be output differently from the second gate signal. However, even in this case, the first gate signal and the second gate signal may be output at a time interval of ½ period of the gate shift clock GSC.

In other words, as shown in FIGS. 6 and 7, the first selector 230*a* may output the gate signal X1 by synchronizing the gate signal X1 transmitted to the first transistor T1 at the time of rising of the gate shift clock GSC, and the second selector 230*b* may output the scan signal X2 by synchronizing the scan signal X2 transmitted to the second transistor T2 at the time of falling of the gate shift clock GSC.

Accordingly, in the present invention, two scan signals input to the plurality of transistors formed in one pixel may be output at a time interval as much as at least ½ period of the gate shift clock GSC.

Also, a third gate signal X3 and a fourth gate signal X4 output from the second stage Stage 2 are the gate signals input to the first transistor T1 and the second transistor T2 formed in the pixels corresponding to the gate line connected with the second stage Stage 2, and as shown in FIG. 7, are output to the panel at a time interval corresponding to at least one half period of the gate shift clock together with the first gate signal X1 and the second gate signal X2 output through the first stage. A fifth gate signal X5 and a sixth gate signal X6 output from the third stage Stage 3 are also the gate signals input to the first transistor T1 and the second transistor T2 formed in the pixels, and are output to the panel at a time interval corresponding to 1 period of the gate shift clock together with the third gate signal and the fourth gate signal.

In order to perform the aforementioned functions, as shown in FIG. 6, each selector 230 may include a multiplexor for receiving the selection signal SEL, the clock GSC and the inverted signal to output either the clock or the inverted signal in accordance with the selection signal, an output unit for synchronizing the input signal with the signal output from the selector and outputting the synchronized signal, and an amplifier for amplifying the signal output from the output unit and outputting the amplified signal as the scan signal.

In other words, the multiplexor selects the clock or the inverted signal inverted from the clock in accordance with the selection signal SEL. The multiplexor may select whether to output the gate signal at the time of rising of the clock or at the time of falling of the clock. If the multiplexor selects to output the gate signal at the time of the falling of the clock, the gate signal is output at the rising edge of the inverted gate shift clock which corresponds to the falling edge of the gate shift clock.

Also, the output unit may include a D-flip-flop (DFF), and generates the gate signal by synchronizing the input signal with the signal output from the multiplexor as described above. However, the gate signal output from the output unit may too small to be applied to the panel. In this case, the gate signal may be output by being amplified by the amplifier that includes a level shifter (L/S).

Figure 8:
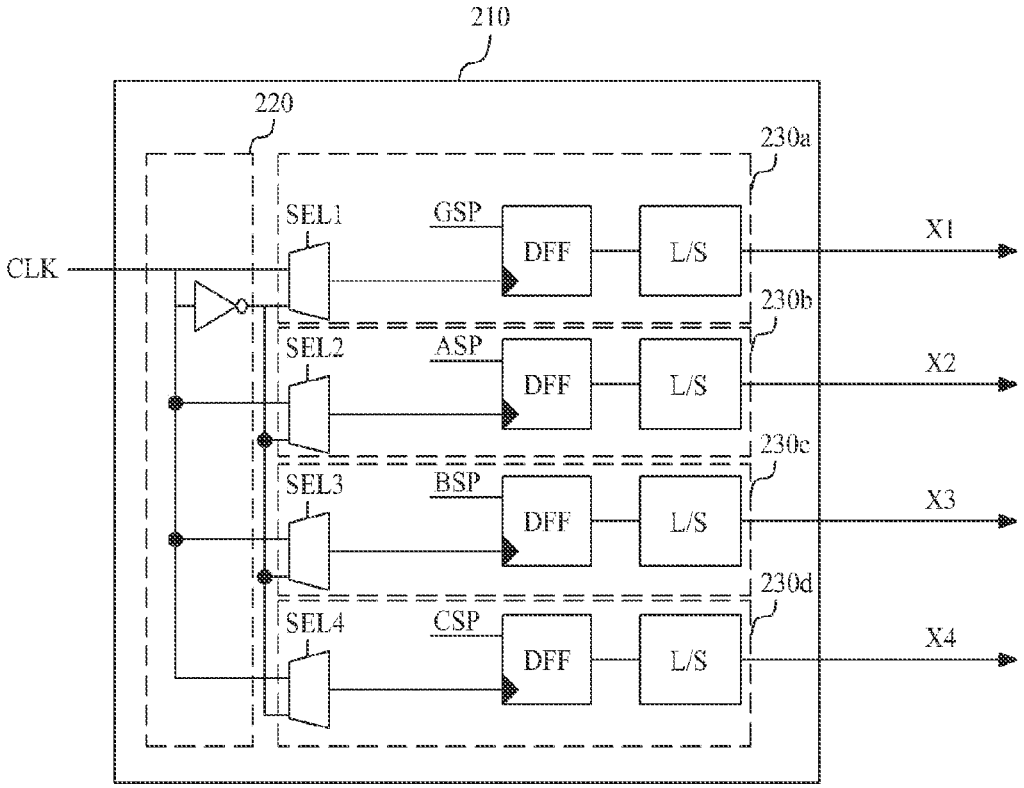
FIG. 8 is an exemplary view illustrating an inner structure of a stage applied to an organic light emitting diode display according to the second embodiment.
Figure 9:
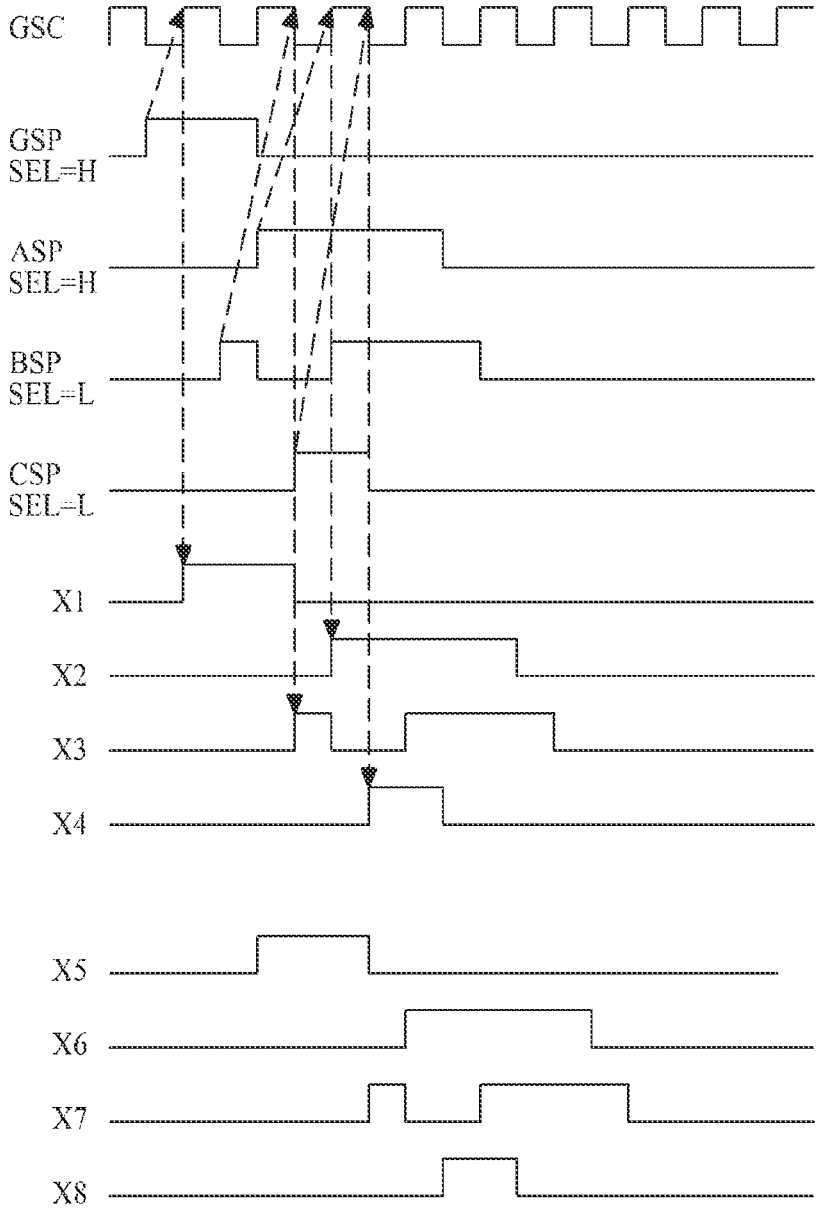
FIG. 9 is an exemplary view illustrating various waveforms applied to an organic light emitting diode display according to the second embodiment shown in FIG. 8.
Figure 10:
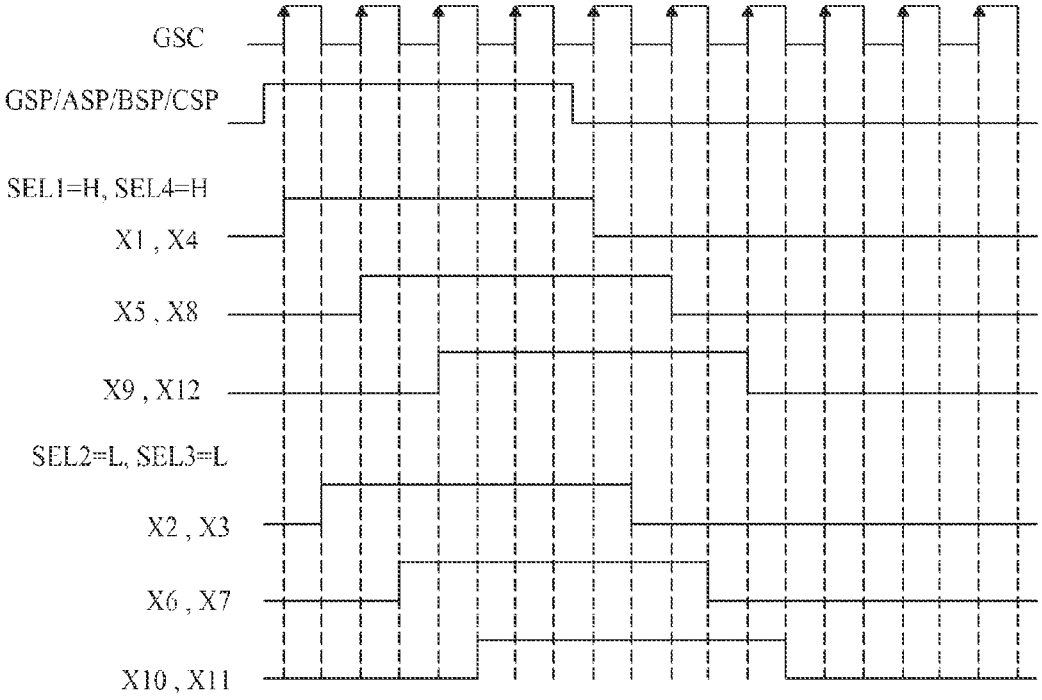
FIG. 10 is an exemplary view illustrating various waveforms applied to an organic light emitting diode display according to the third embodiment.

FIG. 8 is an exemplary view illustrating an inner structure of a stage applied to an organic light emitting diode display according to the second embodiment of the present invention. FIG. 9 is an exemplary view illustrating various waveforms applied to an organic light emitting diode display according to the second embodiment of the present invention, especially illustrating an organic light emitting diode display that uses four gate signals that are distinct from each other. FIG. 10 is an exemplary view illustrating various waveforms applied to an organic light emitting diode display according to the third embodiment of the present invention, especially illustrating an organic light emitting diode display that uses four gate signals which are the same as one another. In other words, the waveforms shown in FIG. 9 illustrate four input signals different from one another, and the waveforms shown in FIG. 10 illustrate that four input signals are the same as one another. Hereinafter, the repeated description of the description in FIG. 5 to FIG. 7 will be made briefly or omitted.

First of all, the second embodiment of the present invention, which is shown in FIGS. 8 and 9 relates to an organic light emitting diode display where four gate signals are output to each pixel where the four gate signals are distinct from one another. As shown in FIG. 8, each stage 210 of the gate driver generates and outputs four gate signals.

Particularly, the waveforms shown in FIG. 9 illustrate four gate signals X1, X2, X3 and X4 output to transistors of a pixel when four input signals GSP, ASP, BSP and CSP are input at their respective forms and periods different from one another. ASP, BSP, and CSP represent different start pulses.

In this case, the first gate signal X1 is the signal output to a first transistor of a pixel by synchronizing the first input signal GSP at the time of rising of the gate shift clock GSC through the first selection signal SEL=H of high level. The second gate signal X2 is the signal output to a second transistor of the pixel by synchronizing the second input signal ASP at the time of rising of the gate shift clock GSC through the second selection signal SEL=H of high level. The third gate signal X3 is the signal output to a third transistor of the pixel by synchronizing the third input signal BSP at the time of falling of the gate shift clock GSC through the third selection signal SEL=L of low level. The fourth gate signal X4 is the signal output to a fourth transistor of the pixel by synchronizing the fourth input signal CSP at the time of falling of the gate shift clock GSC through the fourth selection signal SEL=L of low level.

Also, the fifth gate signal X5 to the eighth gate signal X8 are the signals output from another stage and output to the pixels formed in a horizontal line different from a horizontal line to which the first gate signal X1 to the fourth gate signal X4 are output. It is noted that the fifth gate signal X5 to the eighth gate signal X8 are output at a time interval corresponding to at least one half period of the gate shift clock from each of the first to fourth gate signals.

Next, in the same manner as the second embodiment, the third embodiment of the present invention, which is shown in FIG. 10 relates to an organic light emitting diode display where four gate signals are output to each pixel. As shown in FIG. 10, each stage 210 of the gate driver generates and outputs four gate signals.

However, in the third embodiment of the present invention shown in FIG. 10, the first to fourth input signals GSP, ASP, BSP and CSP are input to the stage in the same form. Also, the first gate signal X1 and the fourth gate signal X4 are synchronized and output at the time of rising of the gate shift clock GSC by the first selection signal SEL1=H and the fourth selection signal SEL4=H, which are set to high level. Accordingly, the first gate signal X1 and the fourth gate signal X4 are shown in one waveform.

Likewise, the first to fourth input signals are input to the stage in the same form. Since the second gate signal X2 and the third gate signal X3 are synchronized and output at the time of falling of the gate shift clock by the second selection signal SEL2=L and the third selection signal SEL3=L, which are set to low level, they are shown in one waveform.

Hereinafter, characteristics of the present invention described as above will be described briefly.

In the present invention described as above, the gate signals are controlled independently from one another, and the form of each of the gate signals may be varied depending on the form of each input signal.

For example, FIG. 9 illustrates that the number of gate signals is 4, wherein the number of gate signals may be varied depending on a structure of a pixel 110.

In other words, the structure of the pixel is varied depending on a method for compensating an organic light emitting diode display, and the number of gate signals is increased if the structure of the pixel becomes complicated. However, the number of the transistor is not always the same as the number of gate signals.

Referring to FIG. 9 again, since four gate signals exist in FIG. 9, the outputs from the stage are operated in a unit of 4. The first input signal GSP is output as the first gate signal X1, the fifth gate signal X5, and the ninth gate signal X9, and the second input signal ASP is output as the second gate signal X2, the sixth gate signal X6, and the tenth gate signal X10. The third input signal BSP and the fourth input signal CSP are output in the same manner as the first and second input signals.

Also, if the first selection signal of the first input signal GSP is high level (SEL=H), the first gate signal X1, the fifth gate signal X5 and the ninth gate signal X9 are sequentially output at the time of rising of the gate shift clock GSC, and the second to fourth selection signals ASP, BSP and CSP are driven in the same manner as the first gate signal X1.

Accordingly, according to the present invention, in the same manner as the gate signal X2 and the third gate signal X3 shown in FIG. 9, the gate signals may be operated in a unit of at least ½ clock unit (½ period of the gate shift clock) between adjacent channels.

Also, in the present invention, in addition to the structure of four gate signals, even in the case that two or more gate signals are required, the interval of the gate signals may be controlled through the selection signal in a unit of at least ½ clock.

As described above, the advantages of present invention may be obtained as follows.

Since the gate signals input to the transistors adjacent to each other in one pixel are input to the pixel at an interval corresponding to at least ½ of the gate shift clock, the output timing of the image in each pixel may be put forward, whereby picture quality may be improved.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting diode display comprising:

a panel including a plurality of pixels formed by crossings of a plurality of gate lines and a plurality of data lines, each pixel including an organic light emitting diode and a plurality of transistors;

a timing controller configured to generate a gate shift clock; and a gate driver configured to receive the gate shift clock and output a plurality of gate signals to the plurality of transistors of each of the pixels based on the gate shift clock, the plurality of transistors turned on or turned off based on the plurality of gate signals, the gate driver outputting at least one of the gate signals to a corresponding one of the plurality of transistors shifted by a time interval of one half of a period of the gate shift clock, wherein the gate driver includes a plurality of stages, each stage is coupled to a corresponding pixel and transmits a plurality of gate signals to corresponding transistors of the corresponding pixel, each stage of the gate driver including an inverter unit that inverts the gate shift clock and outputs the gate shift clock and the inverted gate shift clock and each stage further includes a plurality of selectors, each selector coupled to the inverter unit and one of the plurality of transistors of a pixel, at least one selector outputting a gate signal to a gate of one of the transistors coupled to the selector based on the gate shift clock and at least another selector outputting a gate signal to a gate of another one of the plurality transistors of the pixel based on the inverted gate shift clock, each of the plurality of selectors receiving an inverted signal output from the inverter, the gate shift clock, a selection signal SEL, and an input signal, and if the selection signal SEL corresponds to high level H, each of the plurality of selectors synchronizes the input signal at the time of rising of the gate shift clock and outputs the synchronized input signal as the gate signal, and if the selection signal SEL corresponds to low level L, each of the plurality of selectors synchronizes the input signal at the time of falling of the gate shift clock and outputs the synchronized input signal as another gate signal.

2. The organic light emitting diode display of claim 1, wherein each of the plurality of stages is connected to one another in a cascade arrangement where an output of the gate shift clock of one stage is an input of the gate shift clock to another stage.

3. The organic light emitting diode display of claim 1, wherein adjacent stages of the gate driver output gate signals shifted by a time interval of at least one half a period of the gate shift clock from one another.

4. The organic light emitting diode display of claim 1, wherein each of the plurality of selectors includes:

a multiplexor that selects either the gate shift clock or the inverted gate shift clock for output by the multiplexor; and a flip flop coupled to the multiplexor, the flip flop outputting a gate signal according to the gate shift clock or the inverted gate shift clock outputted by the multiplexor.

5. The organic light emitting diode display of claim 1, wherein a shape of each of the plurality of gate signals is distinct from one another.

6. The organic light emitting diode display of claim 1, wherein a shape of the plurality of gate signals is the same.

7. A method of driving an organic light emitting diode display comprising a panel including a plurality of pixels formed by crossings of a plurality of gate lines and a plurality of data lines, each pixel including an organic light emitting diode and a plurality of transistors, the method comprising:

receiving a gate shift clock; and outputting a plurality of gate signals to the plurality of transistors of each of the plurality of pixels based on the gate shift clock, the plurality of transistors turned on or turned off based on the plurality of gate signals, at least one gate signal outputted to a corresponding one of the plurality of transistors shifted by a time interval of one half a period of the gate shift clock, wherein outputting the plurality of gate signals comprises:

inverting the gate shift clock to generate an inverted gate shift clock;

selecting either the gate shift clock or the inverted gate shift clock to control the output of a gate signal; and outputting the gate signal to a transistor based on the selection, and wherein selecting either the gate shift clock or the inverted gate shift clock comprises:

receiving an inverted signal output from an inverter, the gate shift clock, a selection signal SEL, and an input signal;

if the selection signal SEL corresponds to high level H, synchronizing the input signal at the time of rising of the gate shift clock and outputting the synchronized input signal as the gate signal; and if the selection signal SEL corresponds to low level L, synchronizing the input signal at the time of falling of the gate shift clock and outputting the synchronized input signal as another gate signal.

8. The method of claim 7, wherein the gate shift clock or the inverted gate shift clock controls timing of the output of the gate signal.

9. The method of claim 7, wherein outputting the gate signal comprises:

amplifying the gate signal; and outputting the amplified gate signal to the transistor.

10. The method of claim 7, further comprising:

outputting gate signals to a pair of pixels driven by different gate lines, the gate signals outputted to each pixel in the pair shifted at a time interval of at least one half a period of the gate shift clock from one another.

11. The method of claim 10, wherein outputting the gate signals comprises:

outputting a first plurality of gate signals to a first pixel in the pair;

outputting a second plurality of gate signals to a second pixel in the pair;

wherein the second plurality of gate signals is output at a time interval of at least one half the period of the gate shift clock from when the first plurality of gate signals is output.

12. The method of claim 7, wherein a shape of each of the plurality of gate signals is distinct from one another.

13. The method of claim 7, wherein a shape of the plurality of gate signals is the same.

* * * * *